United States Patent [19]

Koontz

[11] Patent Number: 4,466,210

[45] Date of Patent: Aug. 21, 1984

[54] LOAD SETTER GAUGE

[76] Inventor: Regis A. Koontz, 55 Secret Lake Rd., Avon, Conn. 06001

[21] Appl. No.: 519,321

[22] Filed: Aug. 1, 1983

[51] Int. Cl.[3] ..... F41C 27/00

[52] U.S. Cl. ..... 42/90

[58] Field of Search ..... 42/90, 1 R, 1 A; 86/1 R, 20 R, 20 A, 24, 29, 30

[56] References Cited

U.S. PATENT DOCUMENTS

| | | | |
|---|---|---|---|
| 42,741 | 5/1864 | Bradford | 42/90 |
| 1,670,685 | 5/1928 | Marks | 73/700 |
| 1,856,199 | 5/1932 | Tagle et al. | 73/146.3 |
| 3,145,703 | 8/1964 | Hrovat | 124/16 |
| 3,289,480 | 12/1966 | Sams | 73/146.3 |
| 3,391,691 | 7/1968 | Young | 73/700 |
| 3,595,083 | 7/1971 | Dassler | 73/146.3 |

*Primary Examiner*—Charles T. Jordan

[57] ABSTRACT

A hand-held compression gauge for use with a ramrod in the loading of a muzzle-loading firearm comprises a generally cylindrical tube receiving a coiled spring. A member at one end of the spring is positionable relative to a longitudinal slot in the tube to indicate the axial compression of the spring upon the member being axially forced against a ramrod. Alignment of the member with indicia exteriorly adjacent the slot is indicative of an axial force applied to the ramrod.

14 Claims, 5 Drawing Figures

10
22
26
60
200
180
160
140
120
100
80
60
40
20
0
190
170
150
130
110
90
70
50
30
10
14
12
54
52
50
28
18
24
30
42
56
40
16
58
20

LOAD SETTER GAUGE

BACKGROUND OF THE INVENTION

This invention relates to a compression gauge which may be employed for use in connection with a muzzle-loading firearm. More particularly, this invention relates to a compression gauge employed to measure the compression applied to the load and charge during the loading of a muzzle-loading firearm.

The sport associated with muzzle-loading firearms focuses in part on the process of manually loading the firearm in a manner wherein consistent firing characteristics may be obtained. Conventionally, the process of loading the muzzle-loading firearm includes pouring a measured quantity of powder into the firearm barrel, inserting a ball or a ball and patch, and employing a ramrod to tamp the load and charge to a proper degree of compression. Conventionally, the ramrod has one or more markings which align with the end of the barrel of the firearm to indicate that the load and charge have been compressed within certain limits.

The firing characteristics of a muzzle-loading firearm are directly related to the degree of compression applied to the load and charge during the loading process. Because the conventional techniques for loading muzzle-loading firearms may not achieve a consistent and accurate degree of compression of the charge and load, the obtaining of consistent firing characteristics is frequently problematical. The present invention is directed to a new and improved device for accurately applying a proper degree of compression to the load and charge in a muzzle-loading firearm.

BRIEF SUMMARY OF THE INVENTION

Briefly stated, the invention in a preferred form is a hand-held mechanical compression gauge which is adapted to be engaged against the end of a ramrod employed to load a muzzle-loading firearm. The compression gauge comprises a generally cylindrical tube having a diametral slot and an indicia means exteriorly adjacent said slot. A coiled spring is received in the tube and is generally axially compressible within the tube. A seating means at one end of the tube seats one end of the coiled spring. An engagement member is positioned at the other end of the coiled spring. The engagement member is adapted to engage an end of the ramrod. An indicator means is positioned relative to the coiled spring and alignable with the indicia means to indicate the axial compression of the coiled spring. A plug means at the other end of the tube retains the spring and engagement member in the tube. The plug means has an opening which is dimensioned for axially receiving a ramrod so that an end of the ramrod is engageable against the engagement member in a manner whereby the axially compression of the spring is indicative of an axial force applied to the ramrod.

The engagement member is preferably an annular member having a central recess adapted to locate the end of a ramrod. The indicator means is located at the periphery of the engagement member or may simply be the peripheral edge of the annular member. The slot is longitudinally extending so that the indicator means is axially positionable to be exteriorly visible through the slot. The indicia means includes a longitudinally extending scale having a sequence of indicia which preferably relates pressure readings to corresponding longitudinal positions along the scale.

An object of the invention is to provide a new and improved compression gauge for a muzzle-loading firearm.

Another object of the invention is to provide a new and improved compression gauge for measuring the compression applied to the load and charge of a muzzle-loading firearm.

Another object of the invention is to provide a new and improved compression gauge adaptable for use in conjunction with a muzzle-loading firearm to facilitate the loading of the firearm in a uniform and consistent manner and hence provide more consistent firearm firing characteristics.

Another object of the invention is to provide a new and improved compression gauge for a muzzle-loading firearm which gauge has an efficient and relatively simple mechanical structure.

A yet further object of the invention is to provide a new and improved compression gauge which may be relatively easily and efficiently employed in the loading of a muzzle-loading firearm to apply a proper degree of compression to the load and charge.

Other objects and advantages of the invention will become apparent from the drawings and detailed description.

DETAILED DESCRIPTION OF THE INVENTION

With reference to the drawings wherein like numerals represent like parts throughout the several drawings, a compression gauge shown generally as 10 comprises a generally cylindrical tube 12. Tube 12 includes a generally longitudinally extending diametral slot 14 of uniform width. Tube 14 also includes at opposite ends a pair of interiorly threaded portions 16 and 18. Slot 14 extends proximate threaded portion 16 to an axial position generally intermediate threaded portions 16 and 18.

Figures 1, 2, 3:
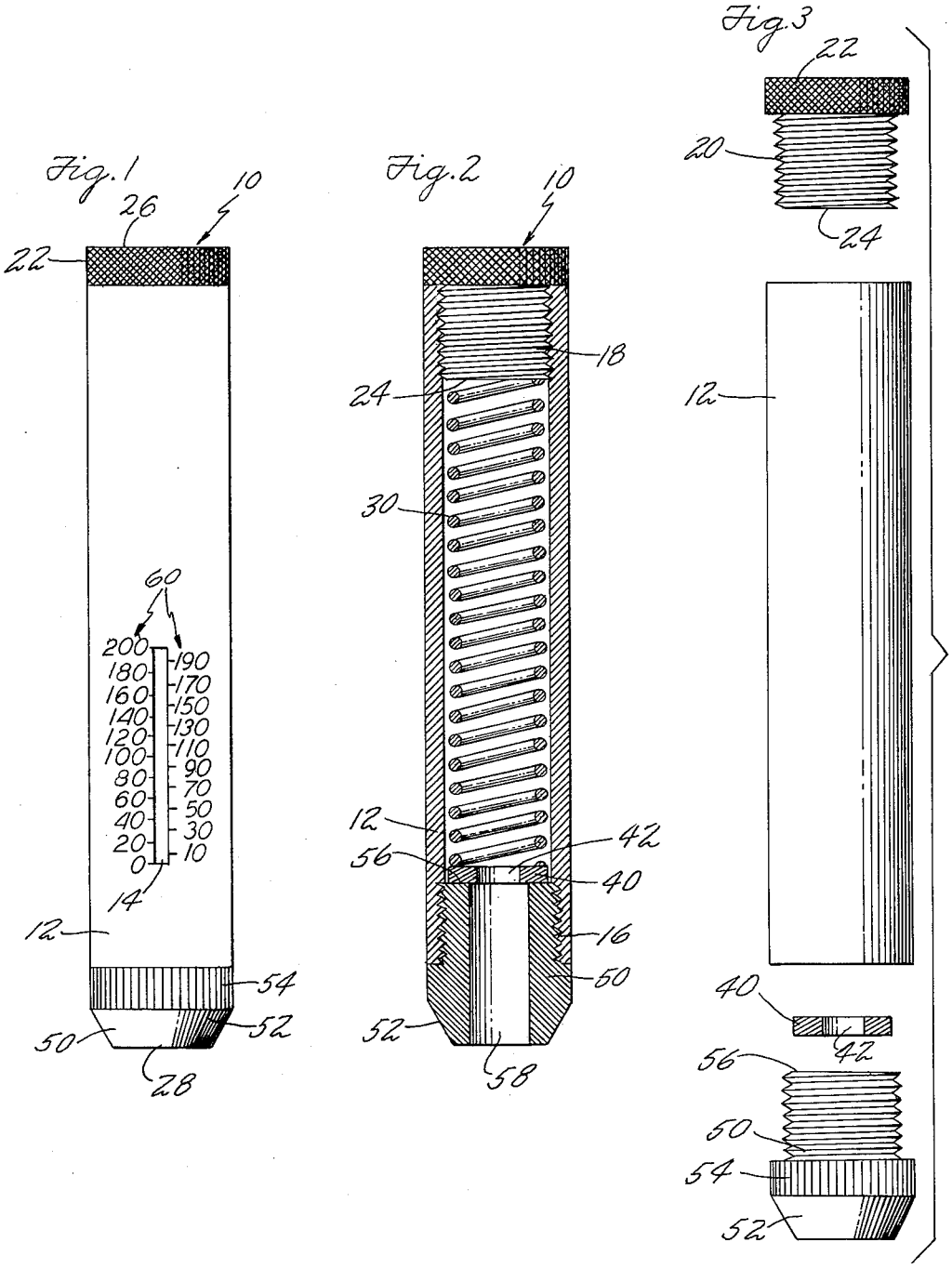
FIG. 1 is side view of a compression gauge of the present invention.
FIG. 2 is a sectional view of the compression gauge of FIG. 1.
FIG. 3 is an exploded view of the compression gauge of FIG. 1.

An end plug 20 having a knurled or ribbed outer surface 22 is threaded into threaded end portion 18. A coiled compression spring 30 is interiorly received in tube 12 and located generally coaxially in tube 12. One end of coiled spring 30 seats against the interior end or seat 24 of end plug 20. A button in the form of an annular or washer-like member 40 is positioned at the opposite end of coiled spring 30. A guide plug 50 defining a central opening through the end of compression gauge 10 is threaded into threaded portion 16 to securably retain spring 30 and member 40 within the tube 12. Tube 12, end plug 20, and guide plug 50 are preferably brass components. The foregoing components are generally dimensioned so that compression gauge 10 may be a hand-held device which is efficiently employed in the manual loading of a muzzle-loading firearm. With reference to FIGS. 1 and 2 the exterior of compression gauge 10 may be generally described as consisting of a generally cylindrical housing with a closed or restricted end 26 and an open end 28.

Guide plug 50 has a forward tapered portion 52 which is adjacent a knurled or ribbed surface 54. Surface 54 is adapted to facilitate manual gripping of the component and the threading of the guide plug 50 into threaded portion 16. Guide plug 50 further includes at an inner radial surface a shoulder 56. Shoulder 56 defines a stop so that member 40 abuts against shoulder 56 when spring 30 is in a normal extended configuration as shown in FIG. 2. A central longitudinally extending opening 58 extends through guide plug 50 from the forward tapered portion 52 to the shoulder 56. Opening 58 is uniformly dimensioned so that a ramrod adapted for loading a muzzle-loading firearm may be received therein. Preferably, the diameter of opening 58 is slightly greater than the corresponding diameter of a ramrod so that guide plug 50 essentially functions as a guide member.

Member 40 is preferably an annular member having a central recess 42. Recess 42 functions to locate the end of a ramrod by seating the rounded projection conventionally extending from the grip end of the ramrod. The peripheral edge of member 40 also functions as an indicator which indicates the degree of axial compression, if any, of spring 30. In this latter regard, member 40 may be provided at the peripheral edge with an indicator mark in the form of a line, a slot, a groove, or any other suitable form as desired.

Figure 4:
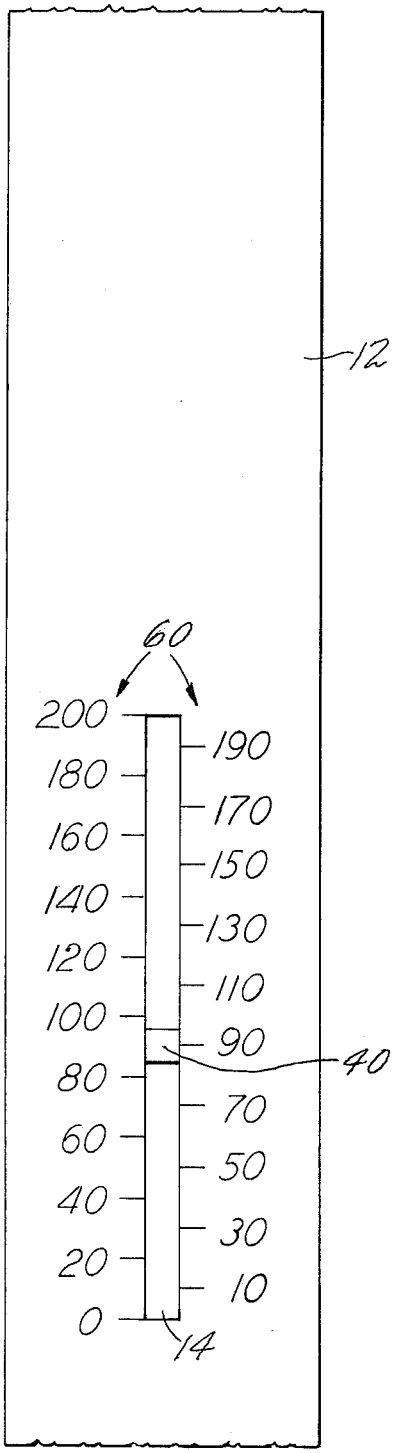
FIG. 4 is an enlarged side view of a portion of the compression gauge of FIG. 1.

With reference to FIG. 4, tube 12 is exteriorly provided with an indicia scale designated generally as 60. Scale 60 is adjacent slot 14 and may be provided with various markings. The markings are preferably calibrated to correspond with various pressure quantities which are a function of the axial compression of compression spring 30 as will be more fully described below. The axial compression of spring 30 can be determined by the axial position of member 40 relative to scale 60. A portion of member 40 is visible through slot 14.

Figure 5:
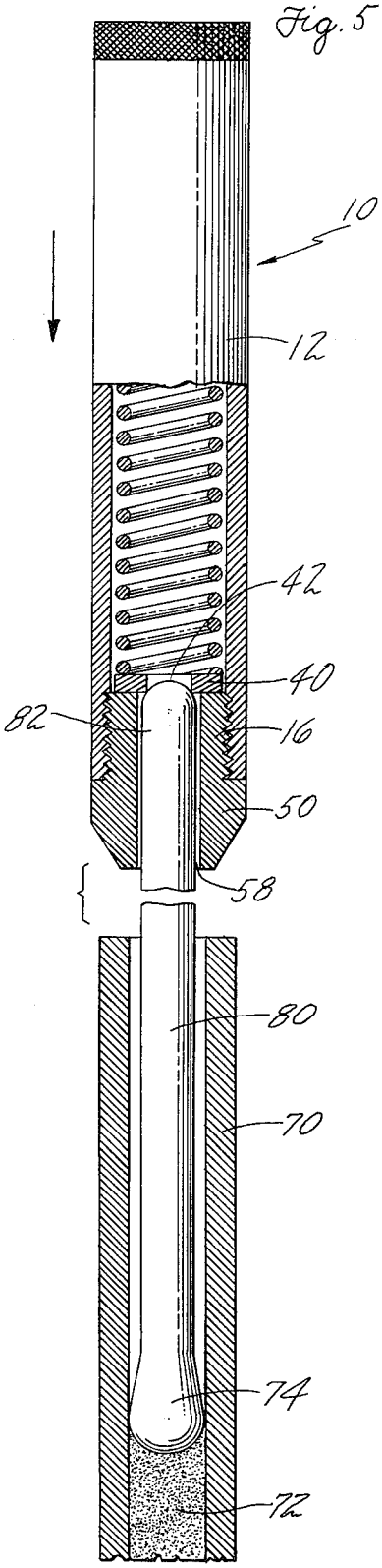
FIG. 5 is a partly sectional view of the compression gauge of FIG. 1 illustrating the preferred application of the present invention in conjunction with a ramrod and a portion of a loaded muzzle-loading firearm.

With reference to FIG. 5, the barrel 70 of a muzzle-loading firearm and a ramrod 80 are illustrated in conjunction with compression gauge 10. The barrel 70 is oriented in a vertical loading position. A measured charge of powder or a powder substitute 72 has been poured into the barrel. A patched ball 74 has also been loaded into the barrel. The ramrod 80 is positioned in the barrel so that the ram end engages against the patched ball 74 to compress the ball and powder. The handle end 82 of the ramrod 80 is slidably received in compression gauge 10 via guide plug 50 to engage against member 40. Ramrod 80 is conventionally shaped at the handle end 82 so that the ramrod can be centrally located by a seating engagement of the ramrod end 82 in recess 42 of member 40.

An external axial force applied to compression gauge 10 in the direction of the arrow will produce a resultant axial compressive force which is transferred through ramrod 80 to patched ball 74 and powder 70. According to well-known principles of physics, the applied axial force will also produce a resultant force acting to axially compress spring 30. The degree of axial compression of spring 30 will thus be indicative of the compressive force applied through ramrod 80 to the load and charge in the muzzle-loading firearm. The peripheral edge of member 40 and any indicator marking thereon are visible through slot 14. The alignment of member 40 with a graduation on scale 60 will thus indicate the axial compression of spring 30 and hence the compressive force on the load and charge in the firearm. The scale 60 may be suitably calibrated to reflect the pressure in pounds per square inch applied to a load and charge by a ramrod for a given compression spring. For example, as illustrated in FIG. 4, the alignment of member 40 with the numeral 90 on the scale 60 may indicate application by the ramrod of a pressure of 90 psi to the load and charge in the firearm.

It may thus be appreciated that the compression gauge of the present invention provides a device of efficient mechanical construction and relative ease of operation providing means whereby the load and charge for a muzzle-loading firearm may be loaded to a given compressive pressure in a consistent and accurate manner.

The foregoing description is set forth for purposes of limitation and should not be deemed a limitation of the present invention. Accordingly, various alternatives, modifications, and adaptations of the present invention may occur to one skilled in the art without departing from the spirit and scope of the present invention.

I claim:

1. A compression gauge for use with a ramrod in the loading of a muzzle-loading firearm comprising:
   - a generally cylindrical tube having a diametral slot and an indicia means exteriorly adjacent said slot;
   - a coiled spring received in said tube and generally axially compressible therein;
   - a seating means at one end of said tube to seat one end of said coiled spring;
   - an indicator means positioned relative to the coiled spring and alignable relative to the indicia means to indicate the axial compression of the coiled spring; and
   - an engagement member positioned against the other end of the coiled spring and engageable with an end of a ramrod so that axial compression of the spring is indicative of an axial force applied to the ramrod.

2. The compression gauge of claim 1 wherein said slot is longitudinally extending, said indicator means being positionable to be exteriorly visible through said slot.

3. The compression gauge of claim 1 wherein the engagement member is an annular member having a central recess adapted to locate the end of a ramrod.

4. The compression gauge of claim 1 further comprising a plug means at the other end of said tube, said plug means having an opening means for axially receiving a ramrod.

5. The compression gauge of claim 4 wherein the plug means includes a shoulder, said spring being retained in said tube by means of the engagement member abutting against said shoulder.

6. The compression gauge of claim 5 wherein the coiled spring normally acts to bias the engagement member to contact against the shoulder of the plug means.

7. The compression gauge of claim 6 wherein the plug means is threaded into the tube.

8. The compression gauge of claim 1 wherein the indicia means comprises a longitudinally extending scale having a plurality of graduations.

9. The compression gauge of claim 1 wherein the engagement member is an annular member, the indicator means being a portion of the peripheral edge of said member.

10. A compression gauge for use with a ramrod in the loading of a muzzle-loading firearm comprising:

a generally cylindrical tube having a restricted end and an opposite open end and a longitudinally extending diametral slot;

a spring disposed in said tube and axially compressible toward the restricted end of said tube from a normal spring configuration; and a button positioned against one end of the spring, a peripheral edge portion of said button being exteriorly visible through said slot and longitudinally positionable therealong so that when an axial force is applied against said button in the direction of the resetricted end, the force acts to compress the spring and the amount of axial compression of the spring can be determined by the longitudinal position of the button.

11. The compression gauge of claim 10 wherein the button is provided with a central recess.

12. The compression gauge of claim 10 further comprising a shoulder positioned interiorly of said tube, said spring biasing the button against said shoulder in the normal spring configuration.

13. The compression gauge of claim 10 further comprising a plurality of graduations exteriorly adjacent said slot.

14. The compression gauge of claim 10 wherein said open end is dimensioned to receive a ramrod.

* * * * *